United States Patent [19]

Chaplin, Jr. et al.

[11] 4,062,503

[45] Dec. 13, 1977

[54] LEVEL WINDING APPARATUS

[75] Inventors: Henry D. Chaplin, Jr.; Stuart E. Wadsworth, both of Cortland, N.Y.

[73] Assignee: Haskell Electronics & Tool Corporation, Homer, N.Y.

[21] Appl. No.: 718,942

[22] Filed: Aug. 30, 1976

[51] Int. Cl.[2] ..... B65H 54/20; B65H 54/28

[52] U.S. Cl. ..... 242/35.5 R; 242/43 R; 242/158 R; 242/158.2; 242/158.4 R

[58] Field of Search ..... 242/35.5 R, 43, 43.1, 242/16, 17, 158 R, 158.2, 158.3, 158.4 R, 158.5

[56] References Cited

U.S. PATENT DOCUMENTS

| | | | |
|---|---|---|---|
| 916,388 | 3/1909 | Clark | 242/35.5 R |
| 1,954,956 | 4/1934 | Sippel | 242/35.5 R |
| 2,400,324 | 5/1946 | Winslow | 242/35.5 R |
| 2,889,577 | 6/1959 | Winer | 242/35.5 R X |
| 3,218,004 | 11/1965 | Meeske et al. | 242/158.2 |
| 3,235,192 | 2/1966 | Scragg | 242/35.5 R |

FOREIGN PATENT DOCUMENTS

| | | | |
|---|---|---|---|
| 19,702 of | 1903 | United Kingdom | 242/35.5 R |
| 695,515 | 8/1953 | United Kingdom | 242/158.4 R |

*Primary Examiner*—Stanley N. Gilreath
*Attorney, Agent, or Firm*—Charles S. McGuire

[57] ABSTRACT

Apparatus for cooperatively moving a plurality of guides for continuous filaments relative to spools upon which they are being wound to insure winding in even, successive layers. Spindles carrying the spools are mounted in parallel arrangement in a plurality of horizontal rows. A single, ball bearing screw is mounted with its axis vertical and carries a traveling member connected to an articulated arm. A linkage arrangement transmits reciprocating motion from the traveling member, through the arm, to a plurality of shafts, each carrying a guide element arranged adjacent one of the spools. The individual threads each pass over one of the guide elements to be moved thereby back and forth along the spool while being wound thereon. A selectively positionable switch arrangement allows adjustment of the limits of travel of the linkage, and thus of the guide elements. Means for adjustably positioning pairs of coaxial guide-carrying shafts are also disclosed, thereby doubling the capacity of the apparatus.

12 Claims, 10 Drawing Figures

LEVEL WINDING APPARATUS

BACKGROUND OF THE INVENTION

The present invention relates to automatic thread spooling, and more particularly to novel apparatus for effecting unitary control of the travel of a plurality of guides for evenly winding continuous filaments on individual spools.

In the manufacture of continuous filaments such as synthetic fibers or threads, it is necessary as a final operation to wind the filaments on individual spools. It has long been the practice to wind a plurality of threads simultaneously on individual spools mounted on a common support base. A guide or so-called level wind assembly is provided adjacent and movable relative to each spool to position the thread for winding in even, consecutive layers. It has been the general convention in the prior art to provide either individual motion transfer mechanisms for each guide-spool pair or a common traverse with all level on a common mounting. The problems and expense associated with individual control are readily apparent, and mounting the wind mechanism for common traverse has required a system capable of smoothly moving large, heavy and bulky structure.

It is a principal object of the present invention to provide a compact, highly accurate, yet relatively simple and easily controlled apparatus for automatically winding a plurality of continuous filaments on individual spools.

A further object is to provide an automatic spooling station having level wind assemblies moved in unison from a single power source through a simple, lightweight motion transfer linkage.

Another object is to provide novel and improved apparatus for moving in unison a plurality of thread guides in a multiple spooling operation wherein the thread guide motion transfer mechanism, and the thread guides are axially adjustable to accommodate different lengths spools.

Other objects will in part be obvious and will in part appear hereinafter.

SUMMARY OF THE INVENTION

In accordance with the foregoing objects, the invention comprises apparatus for supporting and rotating a plurality of spools upon which individual threads or other such continuous filaments are wound, and a movable thread guide in association with each spool. A single, ball bearing screw is vertically mounted at the center of the back of the apparatus for rotation by a small electric stepping motor. It is from this screw that motion is transmitted simulteneously to all thread guides.

In the disclosed embodiment, the spools are disposed with their axes of rotation in three horizontal rows. Each spool has connected thereto an individual electric torque motor for rotation at a predetermined speed. The filaments are constrained in a groove in the periphery of the cylindrical guide members which are supported on the ends of horizontal shafts adjacent the peripheries of each spool. The guide support shafts are mounted for cooperative, reciprocating, linear movement between positions wherein the grooves in the guide members are adjacent the opposite ends of the spools. It is the mechanism for effecting the cooperative, controlled movement of the guide support shafts with which the invention is principally concerned.

The traveling member engaging the aforementioned vertical screw is connected to an articulated arm which reciprocates vertically with the traveling member. Three linkage members are pivotally connected at one end of each on two sides of the articulated arm and fixedly connected at the opposite ends to respective, horizontally disposed shafts. Vertical reciprocation of the arm and ends of the linkage members connected thereto serves to reciprocally rotate the six shafts, arranged in end-to-end pairs. Arms keyed at one end to the shafts are connected at their opposite ends to the guide support shafts. The reciprocating arcuate movement of the arm ends is translated to reciprocating linear motion of the shafts, providing the desired movement of the guide members.

In another disclosed construction, means are provided for cooperating adjusting a pair of coaxial thread guide shafts. The thread guide members on the end of each shaft are thus adjustable with respect to each of a pair of coaxial spools. The capacity of the spooling operation is thereby effectively doubled while allowing the use of spools having different axial lengths.

DETAILED DESCRIPTION

Figure 1:
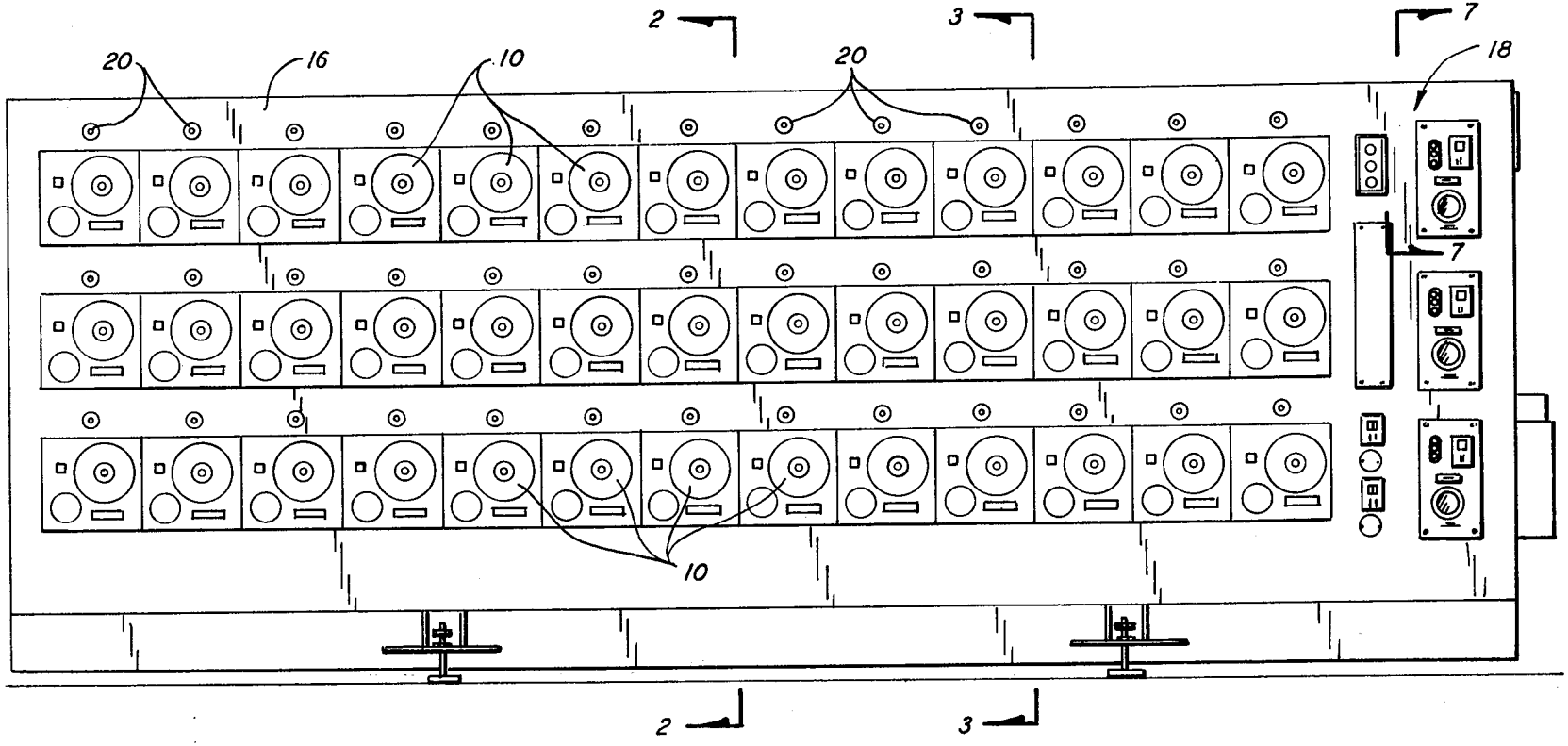
FIG. 1 is a front elevational view of the preferred embodiment of the spooling apparatus.

Referring now to the drawings, the apparatus is seen in FIG. 1 from the side upon which the spools are mounted for winding the continuous filaments, hereafter referred to as thread. Spools 10 are supported upon output shafts 12 of electric motors 14 for rotation thereby. The motors are mounted upon support plate 16, forming a portion of rigid frame structure 17, in three horizontal rows of thirteen motors each, in the illustrated embodiment. Also mounted upon support plate 16, near one end thereof, are appropriate switches and controls 18 for selective operation of various elements of the apparatus.

Figure 3:
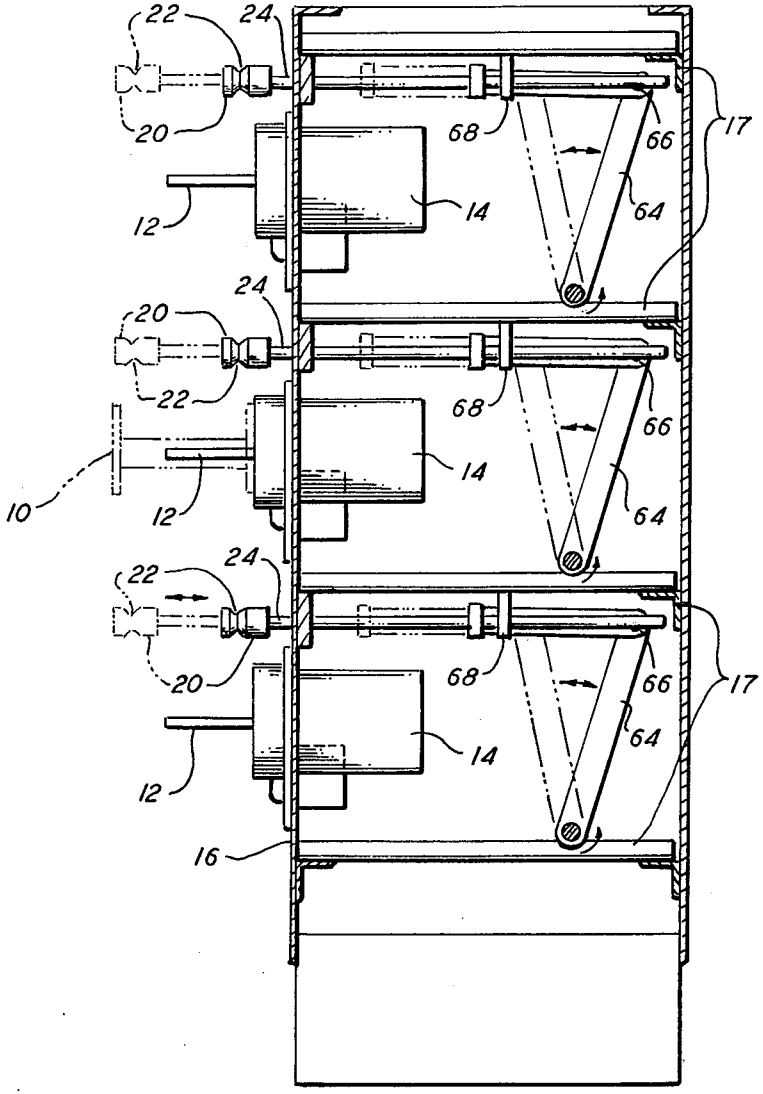

Thread guide members 20, each having a groove 22 in the periphery thereof, are supported on the ends of support shafts 24 pass through openings in support plate 16 for sliding, reciprocal movement by mechanism described later herein. A bundle of thirty-nine threads (or less, if all spools are not in operation) is led to a position adjacent one end of the apparatus; the individual threads are then trained over guide members 20, each thread passing through groove 22 of its respective guide member, and wound around the adjacent spool 10. As motors 14 rotate spools 10 to wind the threads thereon, guide members 20 are moved back and forth between the positions indicated in solid and dotted lines in FIG. 3.

Figure 2:
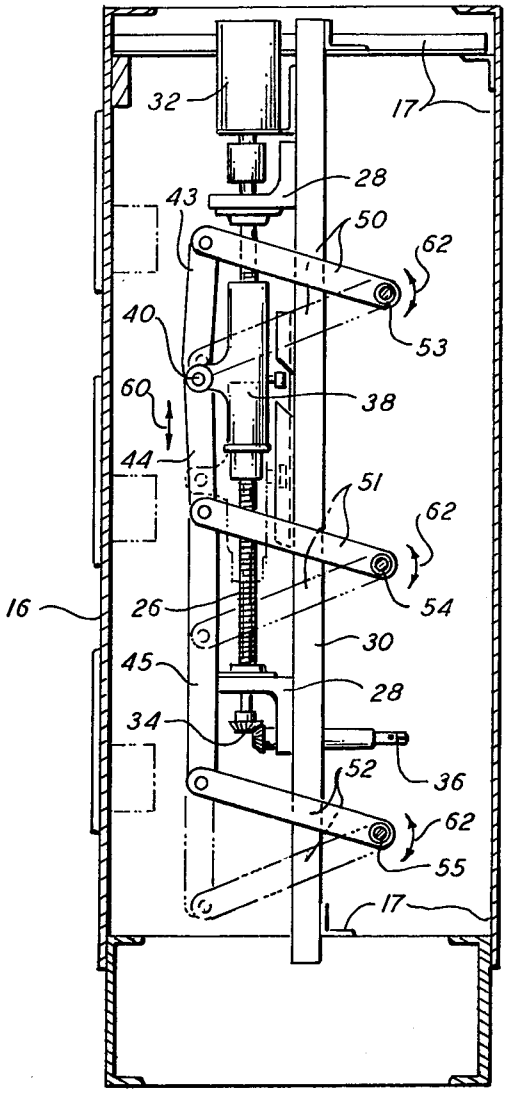
FIGS. 2 and 3 are side elevational views in section on the lines 2—2 and 3—3, respectively, of FIG. 1.

As seen in FIG. 2, screw 26 is supported at its opposite ends by brackets 28 extending from support column 30, the latter being suitably anchored to portions of frame structure 17. The output shaft of stepping motor 32 is connected to the upper end of screw 26 for rotation thereof in either direction. The lower end of screw 26 is connected, through bevel gears 34, to shaft 36 to which a hand crank may be attached for manually turning screw 26 during maintenance or adjustment of the apparatus.

Figure 4:
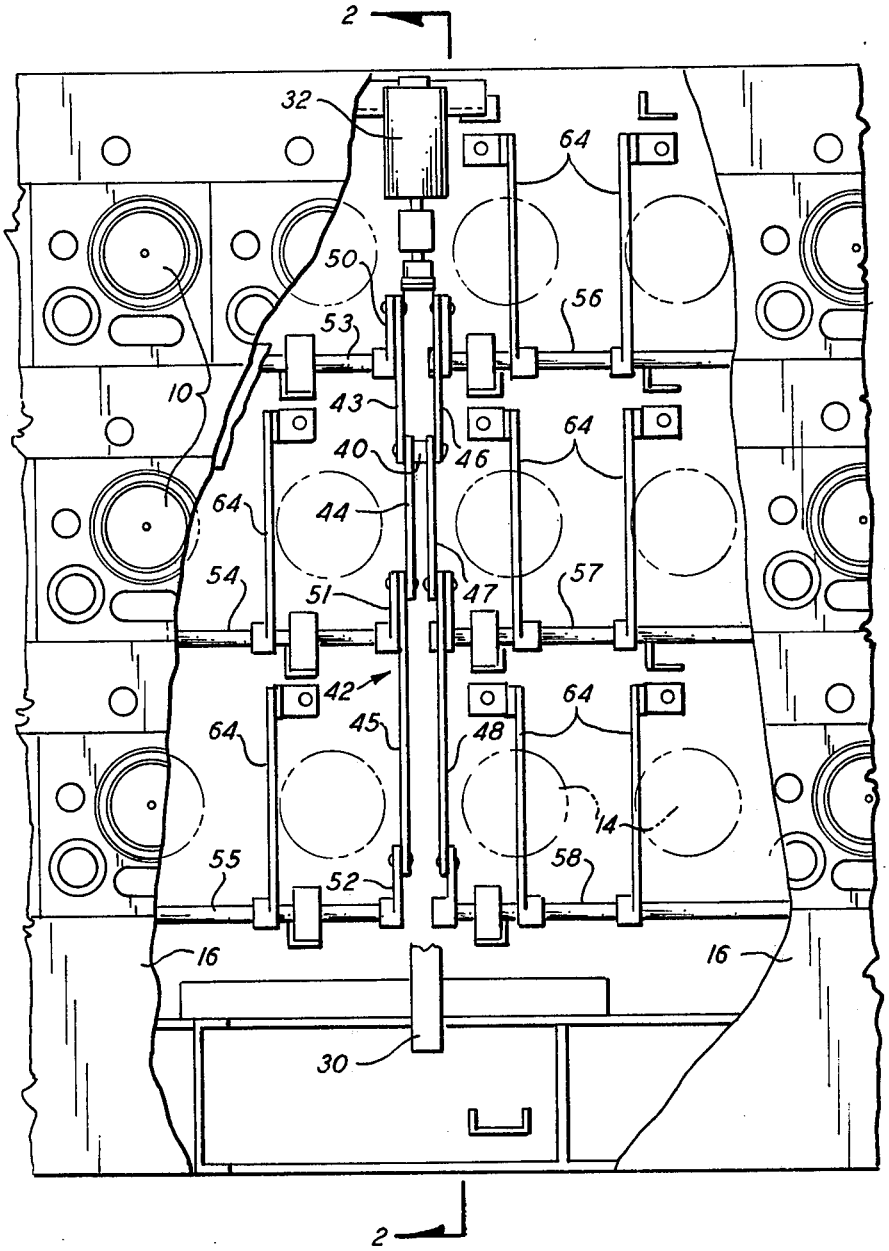
FIG. 4 is a fragmentary, somewhat enlarged, front elevational view, with a portion broken away to show elements of the mechanism at the rear of the apparatus.
Figure 7:
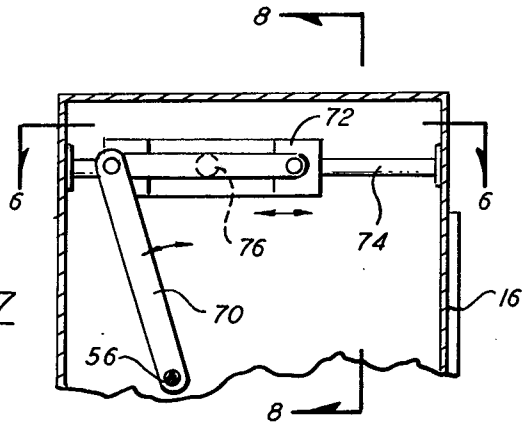
FIG. 7 is a fragmentary, side elevational view, in section on the line 7—7 of FIG. 1.
Figure 8:
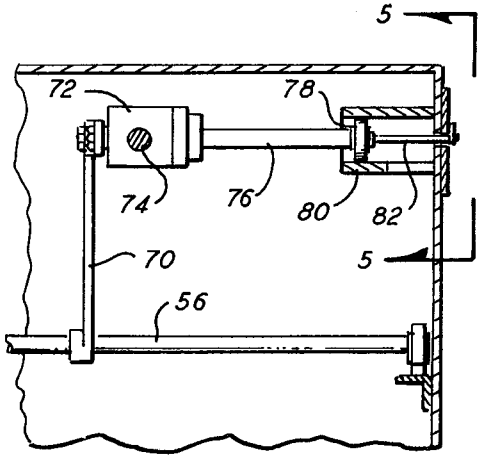
FIG. 8 is a fragmentary front elevational view of the same portion of the apparatus, in section on the line 8—8 of FIG. 7.

Traveling member 38 engages the threads of screw 26 for vertically reciprocating movement as the screw is rotated in opposite directions. Preferably, traveling member 38 is of the type which internally supports ball bearings which engage the threads of screw 26, thereby forming a system commonly known as a ball bearing screw. Member 38 is connected at 40 to a compound, articulated arm, denoted generally by reference numeral 42 and comprising a total of six links, all of which may be seen in FIG. 4. One side of arm 42 is comprised of links 43, 44 and 45, the other side being identically constructed of links 46, 47 and 48. The side of arm 40 seen in FIG. 2 is connected through linkage members 50, 51 and 52 to horizontally disposed shafts 53, 54 and 55, respectively. The other side of arm 40 is connected through identical linkage members to shafts 56, 57 and 58, as seen in FIG. 4. The six shafts are supported for rotation upon suitable portions of frame structure 17 in end-to-end pairs, as also seen in FIG. 4, shafts 53 and 56 forming the upper pair, shafts 54 and 57 the middle pair and shafts 55 and 58 the lower pair.

Linkage members 50, 51 and 52, and the three identical linkages members on the other side of arm 40, are each keyed to their respective shafts. Thus, as screw 26 rotates to move traveling member 38, the vertically reciprocating movement of arm 40, indicated in FIG. 2 by arrow 60, is translated through the linkage members to reciprocating rotation of the shafts, as indicated by arrows 62. The arcuate path of the ends of the linkage members connected to form arm 42 is accommodated by the articulation of the arm.

Arranged along the length of each of shafts 53–58, and keyed thereto at one end, are a plurality of arms, all of those shown being indicated by common reference numeral 64. One of arms 64 is provided for association with each of guide support shafts 24, one end of each arm and shaft being connected at 66. As shafts 53–58 are reciprocally rotated in the manner described, arms 64 and guide support shafts 24 are moved between the positions shown in solid and dot-dash lines in FIG. 3. Guide support shafts 24 are constrained for linear movement by brackets 68, fixedly attached to frame structure 17, and the openings through which they pass in support plate 16. Thus, all of thread guides 20 are moved in unison to traverse the length of spools 10, causing the threads to be wound in even layers thereon. The ends of arms 64 connected to shafts 24 include a slotted opening, or other appropriate connecting means which allow arcuate movement of the ends of arms 64.

The limits of movement of thread guides are controlled by adjustable limit switches, the motion control mechanism being located at one end of the apparatus and shown in FIGS. 5–8. Arm 70 is keyed at one end to shaft 56 and connected at the other end to bearing member 72, mounted for reciprocal sliding movement on fixed shaft 74. Shaft 76 extends from bearing member 72 and carries roller 78 which is constrained within guide 80. Rod 82 extends fixedly from the end of shaft 76 through slot 84 in plate 86, mounted on the right side (as seen in FIG. 1) of the apparatus.

Figure 6:
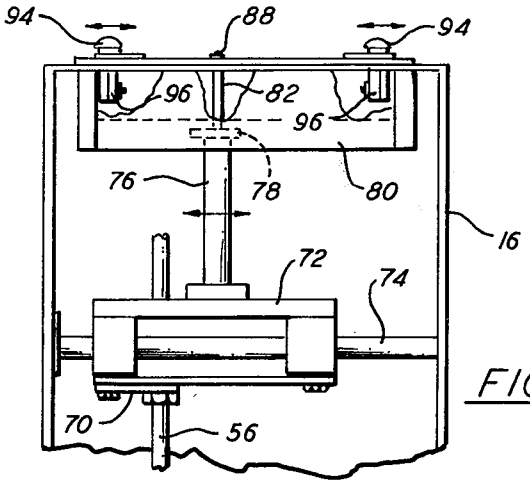
FIG. 6 is a fragmentary, top plan view of one end of the apparatus, as seen from the line 6—6 of FIG. 7.
Figure 5:
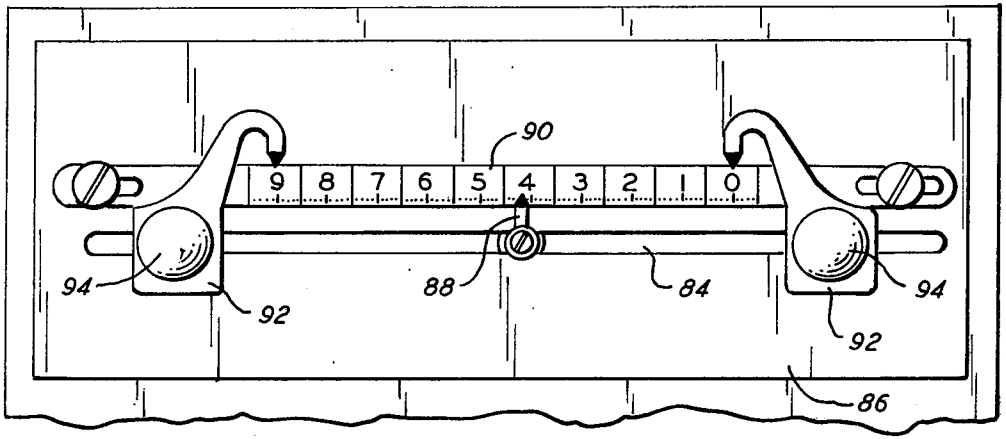
FIG. 5 is a fragmentary, elevational view of a portion of one end of the apparatus, as seen generally from the line 5—5 of FIG. 8.

Rod 82 carries pointer 88 on the outside of the apparatus for movement relative to scale 90. Limit indicators 92 include end portions adjacent scale 90 and may be selectively positioned along slot 84 by loosening and tightening thumb screws 94. Indicators 90 extend through slot 84 and carry on their opposite ends microswitches 96 (FIG. 6). Contact of rod 82 with microswitches 96 serves to reverse the direction of stepping motor 32 through appropriate electrical connections. Thus, each time rod 82 contacts one of microswitches 96, the direction of traveling member 38 is reversed, as is that of arm 42 and the various links, arms and shafts. The limits of travel of thread guides 20 are thereby controlled in accordance with the position of microswitches 96. Movement of rod 82 is precisely constrained by roller 78 riding within fixed guides 80 and bearing member 72 riding upon fixed shaft 74.

Figures 9, 9A:
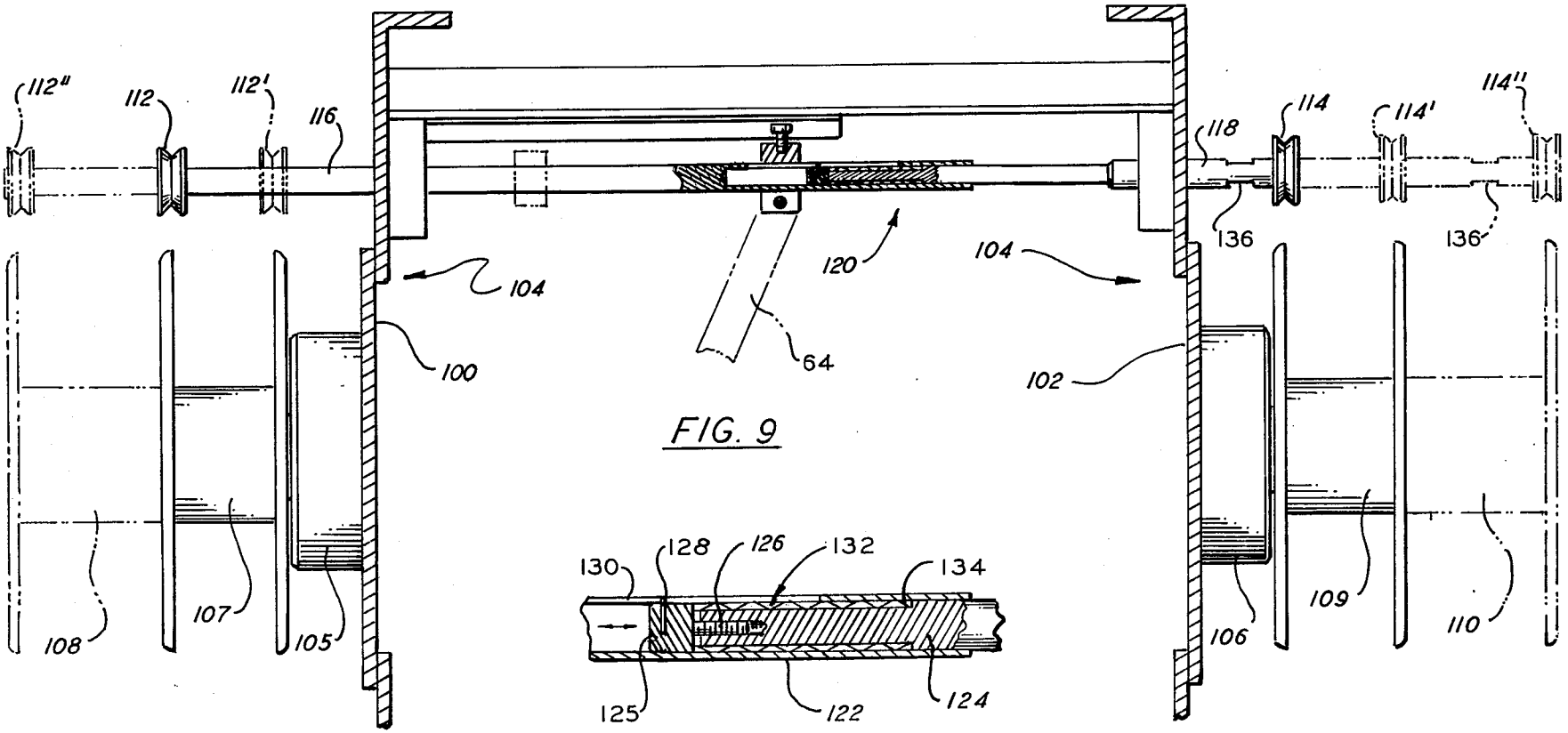
FIG. 9 is a fragmentary, side elevational view, partly in section, showing an alternate construction for simultaneously winding upon two coaxial spools; and FIG. **9*a* is an enlarged fragment of FIG. 9**.

Referring now to FIG. 9, an arrangement for moving thread guides arranged in coaxial pairs is illustrated. The motion transfer mechanism including screw 26, articulated arm 42, linkage members 50–52, shafts 53–58 and arms 64 is provided for reciprocation movement of the thread guide shafts in the manner previously described. Since construction and operation of these elements, as well as the motion limit control mechanism, may be identical to those already shown and described, they are not repeated in FIG. 9. In this construction, two mounting plates 100 and 102, comprising a part of frame structure 104, serve as supports for motors 105 and 106, respectively, each having output shafts for rotation of associated spools.

In order to illustrate the intended purpose of this construction, a pair of spools 107 and 108 are shown mounted upon the spindle rotated by motor 105, and a similar pair of spools 109 and 110 are shown mounted for rotation by motor 106. It will be understood, of course, that only a single spool will be mounted on each spindle at any given time, and that all spools mounted upon the spooling apparatus at the same time will be of the same axial length. That is, either the longer spools 108 and 110 or the shorter spools 107 and 109 may be mounted at any given time.

Thread guides 112 and 114 are fixedly secured to the ends of guide support shafts 116 and 118, respectively, which pass through openings in frame structure 104 for reciprocal, sliding movement. Shafts 116 and 118 are constructed for coaxial, telescoping engagement. They are joined at their inner ends by a frictionally engageable and releasable bushing assembly, generally denoted by reference numeral 120, of a type commercially available from Adjustable Bushing Corporation of North Hollywood, Calif. Such bushings provide means for adjustably fixing the relative axial positions of shafts 116 and 118.

As seen more clearly in the enlarged fragment of FIG. 9A, end portion 122 of shaft 116 is hollow to slidingly receive end portion 124 of shaft 118. Bushing assembly 120 also fits within the hollow end of shaft 116, stop member 125 thereof being engaged with end portion 124 by screw 126. Pin 128 extends fixedly from member 125 into slot 130 in end portion 122 of shaft 116. A plurality of annular bushings, denoted collectively by reference numeral 132, encircle a reduced diameter of end portion 124 between stop member 125 and shoulder 134 on shaft 118. Each of bushings 132 is telescopingly engaged with a larger diameter end of the adjacent bushing. When the bushings are axially compressed between stop member 125 and shoulder 134, the telescoping engagement caused them to expand radially, providing a tight frictional engagement between end portions 122 and 124 of the shafts, preventing any relative movement thereof.

When the axial positions of shafts 116 and 118 are to be adjusted, flats 136 (FIG. 9) on the end of shaft 118 are engaged by a wrench and the shaft is rotated. Shaft 116 cannot rotate due to its engagement with arm 64, as described in connection with the previous construction. Likewise, member 125 cannot rotate due to fixed pin 128 thereof extending into slot 130 in shaft 116. Thus, rotation of shaft 118 in the proper direction serves to loosen the engagement therewith of screw 126, allowing axial expansion and thereby radial contraction of bushings 132. This releases the frictional engagement of shafts 116 and 118, allowing relative axial movement thereof to the desired position. After the axial adjustment is made, flats 136 are again engaged by the wrench and shaft 118 is rotated to axially compress bushings 132, reestablishing the frictional engagement of shafts 116 and 118. When short spools 107 and 109 are used, the axial positions of shafts 116 and 118 are relatively fixed with thread guides 112 and 114 in the position shown in solid lines of FIG. 9, or in the positions indicated by reference numerals 112' and 114'. The motion control mechanism previously described and shown in FIGS. 5–8 is adjusted to provide a distance of reciprocating travel of the thread guides between the positions indicated by reference numerals 112 and 114 and those indicated at 112' and 114', whereby threads will be properly guided for winding upon spools 107 and 109.

When long spools 108 and 110 are used, the frictional engagement of shafts 116 and 118 is released as previously described with thread guide 112 in the position indicated by numeral 112'. Shaft 118 is then moved axially to move thread guide 114 from the position at 114' to that at 114''. Shaft 118 is then counter-rotated by the wrench to again be frictionally engaged with shaft 116. The motion control mechanisms is again adjusted to provide a distance of reciprocating movement of the shafts which moves one thread guide between 112' and 112'' as the other moves between 114'' and 114, respectively. Thus, thread will be properly guided for winding upon long spools 108 and 110.

By means of the construction of FIGS. 9 and 9A, the apparatus may be easily adjusted to provide proper guiding of thread for winding on spools of any length, up to a predetermined maximum. Capacity of the apparatus is thereby doubled. Adjustment is accomplished entirely from one side of the apparatus, without necessity of access to the space between the two frame portions which, in effect, form walls on each side of the apparatus.

What is claimed is:

1. Apparatus for simultaneously controlling the level winding of a plurality of continuous filaments on separate spools, said apparatus comprising, in combination:

a. a plurality of spindles having parallel, horizontally disposed axes, each adapted to support a spool for winding a continuous filament thereon;

b. drive means for imparting rotation to each of said spindles;

c. a plurality of shafts mounted for reciprocal axial movement, one of said shafts being mounted laterally adjacent and parallel to each of said spindles;

d. a thread guide carried on each of said shafts and having a peripheral groove perpendicular to said axes;

e. a single, elongated, rotatably mounted, threaded member;

f. a traveling member engaged with said threaded member for reciprocating linear movement in response to rotation of said threaded member;

g. a motor for imparting rotation to said threaded member;

h. linkage means connecting said traveling member to each of said shafts to transfer said reciprocating linear movement from said traveling member simultaneously to each of said shafts for effecting said reciprocal axial movement of said shafts;

i. said plurality of shafts including at least one pair of shafts extending in coaxial alignment with one another, each of said pair being arranged laterally adjacent separate ones of said spindles;

j. means mounting said pair of shafts for relative axial adjustment; and k. means for releasably fixing the relative axial positions of said pair of shafts.

2. The invention according to claim 1 wherein said spindles are arranged in a plurality of horizontal rows.

3. The invention according to claim 2 wherein said linkage means includes an articulated arm to which said traveling member is connected.

4. The invention according to claim 3 wherein said articulated arm includes a plurality of links pivotally connected at their ends and equal in number to said horizontal rows.

5. The invention according to claim 4 wherein said linkage further includes elements through which reciprocating movement of said articulated arm is translated to rotary motion, and thence to said movement of said shafts.

6. The invention according to claim 1 and further including switch means operable in response to movement of said linkage means to reverse the direction of rotation of said motor, and thereby said threaded member.

7. The invention according to claim 6 wherein said switch means includes a pair of switch members and further including an element connected to said linkage means for movement thereby into operating contact with said switch members at opposite limits of travel of said linkage means.

8. The invention according to claim 7 and further including means for selectively and individually changing the position of said switch members along the path of movement of said element, thereby altering said limits of travel.

9. The invention according to claim 8 and further including a stationary scale, and indicator means associated with each of said switch members and movable therewith relative to said scale to provide a visual indication of said limits of travel.

10. The invention according to claim 1 wherein said threaded member and said traveling member comprise a ball bearing screw mounted with its axis vertical.

11. The invention according to claim 1 wherein said means for releasably fixing includes an adjustable bushing assembly.

12. The invention according to claim 1 wherein said pair of shafts and said means for releasably fixing comprise means which allow said axial adjustment by manipulation of only one of said pair of shafts.

* * * * *